United States Patent [19]

Rainone et al.

[11] Patent Number: 4,805,326

[45] Date of Patent: Feb. 21, 1989

[54] FRAME FOR RELEASABLY FRAMING ARTICLES

[75] Inventors: John P. Rainone, 87-89 Dyke Road, Brighton, East Sussex, England, BN1 3JE; Derek J. C. Bernard, Jersey, Channel Islands

[73] Assignee: John P. Rainone, East Sussex, England

[21] Appl. No.: 126,205

[22] Filed: Nov. 27, 1987

Related U.S. Application Data

[63] Continuation-in-part of Ser. No. 816,200, Jan. 6, 1986, Pat. No. 4,726,133.

[30] Foreign Application Priority Data

| | | | |
|---|---|---|---|
| Jan. 4, 1985 | [GB] | United Kingdom | 8500243 |
| May 10, 1985 | [GB] | United Kingdom | 8511909 |
| Sep. 20, 1985 | [GB] | United Kingdom | 8523324 |

[51] Int. Cl.[4] ..... A47G 1/06

[52] U.S. Cl. ..... 40/155; 40/152.1

[58] Field of Search ..... 40/155, 152.1, 152

[56] References Cited

U.S. PATENT DOCUMENTS

| | | | |
|---|---|---|---|
| 2,540,907 | 2/1951 | Paschal | 40/155 |
| 2,731,748 | 1/1956 | Polay | 40/155 |
| 2,773,324 | 12/1956 | Drueck, Jr. | 40/155 |
| 2,826,843 | 3/1958 | Fabry | 40/152 |
| 3,065,943 | 11/1962 | Hull | 40/155 |
| 3,812,609 | 5/1974 | Volden | 40/155 |
| 4,489,512 | 12/1984 | Schovee | 40/155 |

*Primary Examiner*—Robert P. Swiatek
*Assistant Examiner*—Cary E. Stone
*Attorney, Agent, or Firm*—Burgess, Ryan & Wayne

[57] ABSTRACT

A frame (10) for releasably framing articles such as pictures, photographs, posters and menus includes a plurality of elongate members (12, 14, 16 18) having mitred ends mated together, and an elastic band (20), the elastic band being located in a continuous channel formed, on assembly of the frame, by the alignment of sub-channels (27) located along the length of each member, and the elastic band being in tension around the frame so as to pull the members together, each sub-channel having an entrance passage leading into it along the whole of its length, the entrance passage allowing the elastic band to be threaded into the channel and preventing the elastic band from being visible after assembly of the frame.

18 Claims, 2 Drawing Sheets

FRAME FOR RELEASABLY FRAMING ARTICLES

This application is a continuation-in-part of application Ser. No. 816,200 filed Jan. 6, 1986 now U.S. Pat. No. 4,726,133.

The present invention relates to a frame for releasably framing articles, such as pictures, photographs, posters, video films, printed circuit boards, table-mats, X-ray plates and menus.

A conventional frame generally comprises four straight frame members having mitred ends fastened together at their ends by means such as pins or adhesive, and which encircle the article to be framed. Once assembled, such a frame is normally quite rigid, making the replacement of the article within the frame by another either time consuming or in some cases impossible.

Several attempts have been made to design frames which overcome this problem. For instance, GB No. 2061108 (Reim) discloses a rectangular frame which comprises L-shaped connecting elements located at each corner, along whose limbs the frame members are slidably received. The frame can therefore be expanded by moving the frame members along the limbs of the connecting elements allowing the framed picture to be taken out and replaced by another.

This arrangement overcomes some of the problems of conventional frames, but is still found to be unsatisfactory. Such a frame is quite complex having eight interengaging elements and is not readily adapted to frame a plurality of pictures. A further problem with this type of frame, is the need to provide securing means at both ends of each frame member to prevent the L-shaped elements becoming detached from the frame members. If the frame members are manufactured by extrusion, the securing means has to be added in an additional stage of manufacture, resulting in increased production costs.

U.S. Pat. No. 3,990,168 (Murray) discloses the use of resilient members located across each corner to urge the frame members into contact with one another. However, it is necessary to provide each frame member with anchoring points so that the resilient members can be attached thereto. Such means complicates the frame members, resulting in the finished frame being prohibitively expensive to manufacture.

A need therefore arises for a much simplified frame, which is easily manufactured, which allows for the interchange of the articles framed, and which can be assembled quickly without requiring any special tools or skills.

According to one aspect of the present invention, there is provided a frame for framing at least one article comprising a plurality of frame members arranged in end to end relationship to form the frame and means consisting solely of an elastic band for maintaining said relationship, the elastic band being disposed in a continuous channel formed around the frame by the alignment of sub-channels located along the length of each of the frame members, each sub-channel having an entrance passage leading into it along the whole of its length arranged both to allow the elastic band to be threaded into the sub-channel and to prevent the elastic band from being visible after assembly of the frame.

Elastic bands of various cross-sections can be used in the invention, for instance circular, oval or rectangular.

Elastic bands having a rectangular cross-section are preferred.

Preferably each of the frame members includes a sub-groove, the sub-grooves of each of the frame members being aligned on assembly of the frame to form a continuous groove around the internal perimeter of the frame for retaining the at least one article in position.

The entrance passage of each frame member may extend between its sub-groove and its sub-channel.

The assembled frame may be designed to have a front surface arranged to face in the same direction as the article to be framed, and a rear surface. In this case, the entrance passage may be arranged to extend between the sub-channel and the surface of each frame member which, in the assembled frame, forms part of the rear surface. In this case, the entrance passage will be hidden from view if the rear surface of the frame lies against a wall.

The frame members may be manufactured by a process such as continuous extrusion from a variety of materials such as plastics or metal.

The frame of the present invention permits the articles which it frames to be rearranged or replaced. This is achieved by each frame member being flexibly urged into contact with its neighbours by the elastic band, allowing a picture retained by the frame to be removed by pulling at least one of the frame members away from the plane of the picture against the tension of the elastic band.

Figure 1:
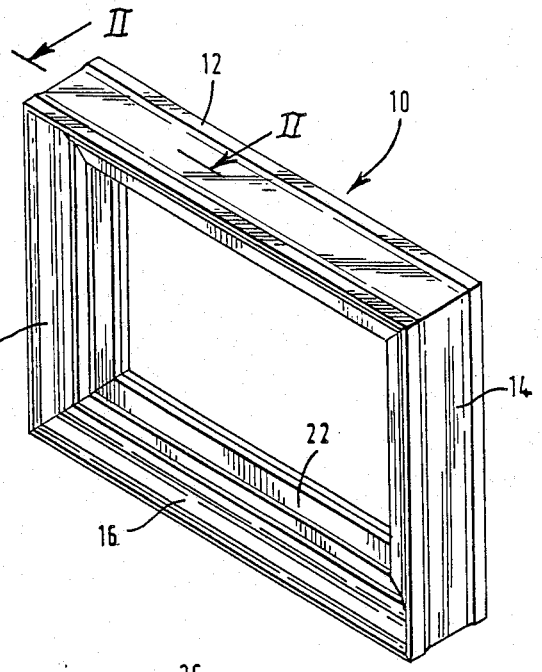
FIG. 1 is a perspective view of a frame according to one embodiment of the present invention.
Figure 2:
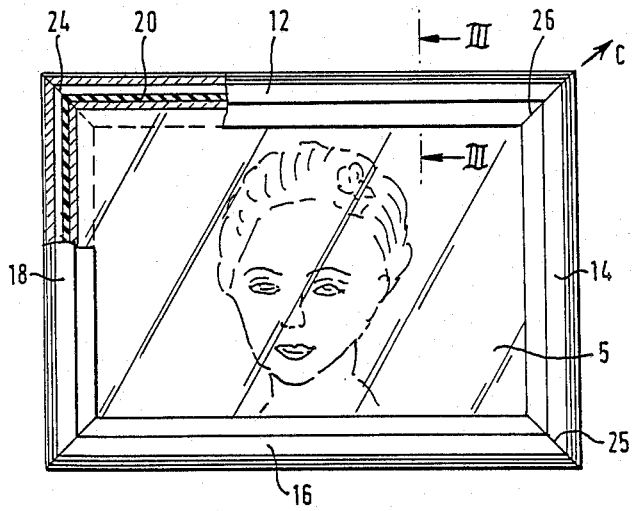
FIG. 2 is a front elevational view of the frame illustrated in FIG. 1, partly in section along the line II—II of FIG. 1 and shown framing a picture.

Referring now to FIGS. 1 and 2, a frame according to one embodiment of the present invention is indicated generally at 10 and comprises four substantially straight frame members 12, 14, 16, 18 arranged in framing relationship. The frame members are maintained in this relationship by an elastic band which is stretched around the frame and which is located in a continuous channel formed within the body of the frame. In accordance with the invention, the individual frame members are formed so that the elastic band is hidden from view after assembly of the frame.

Each frame member has two mitred ends which are urged into contact with the mitred ends of its neighbouring frame members to form the corners of the frame. In the present specification, the mitering of the ends of each frame member is not confined to be at an angle of 45°, but may be varied to any angle suitable for forming the abutting junctions between the frame members.

Figure 3:
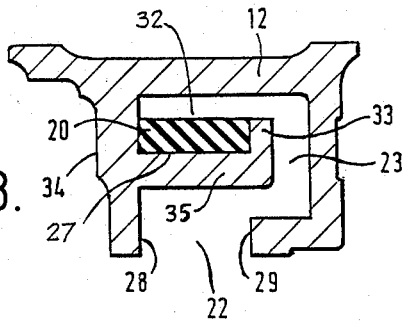
FIG. 3 is a cross-sectional view of a frame member taken along the line III—III of FIG. 2.

Turning now to FIG. 3, this illustrates a cross-section through the frame member 12 of FIG. 2. The frame member includes a sub-channel 32 formed along the whole of its length. The sub-channel has an entrance passage 23 leading into it along the whole of its length, which allows an elastic band 20 to be threaded into the sub-channel 32. The elastic band is preferably of elongate cross-section. The sub-channel includes a supporting surface 27 dimensioned to enable one surface of the elastic band to rest against it under its own tension. A lip 33 is provided at one edge of the sub-channel to help maintain the elastic band in position in the sub-channel.

The sub-channel is enclosed within each frame member apart from at its two ends, and where the entrance passage joins with it.

On assembly of the frame members into a frame, the individual sub-channels are aligned to form a continuous channel within the body of the frame. The elastic band 20 is located within this channel and stretches around the frame to urge the frame members into framing relationship. The entrance passage 23 is configured so that the elastic band is not visible once the frame has been assembled.

Each frame member has a sub-groove 22 formed along the surface which forms part of the internal perimeter of the frame. The sub-groove of each frame member has walls 28, 29. When the frame members are assembled into a frame, the individual sub-grooves of the frame members become aligned to form a continuous groove around the frame's internal perimeter. The walls 28, 29 retain the framed article or articles 5 within the groove by preventing there falling either forward or backward with respect to the frame.

In manufacturing the frame members, the width of the sub-groove may be varied to allow different frames to accommodate articles having different widths.

In the embodiment illustrated in FIG. 3, the entrance passage 23 extends through a side wall of the sub-groove 22. The elastic band 20 is threaded into the sub-channel by way of the sub-groove, and then the entrance passage. A tongue 35 projects from the opposite side wall of the sub-groove, a first surface of which forms the base of the sub-groove, and the opposite face of which forms the face of the sub-channel which supports the elastic band.

Each of the frame members is urged into contact with its neighbours solely by the elastic band. Consequently, the junctions 24,25,26 between the individual frame members are flexible, allowing the frame to be flexed at each of its corners. For instance, any two adjacent frame members may be flexed at their junction by as much as 180° with respect to the remaining frame members to allow either a picture to be placed in the frame, or a picture or pictures already in place to be removed or reordered.

It is preferred that the cross-section of each frame member is constant along its length, except for at its mitred ends. In this case, the frame members can be formed in a single continuous extrusion step from metal or plastics or by a simple continuous machining process from wood strip. Alternatively, each frame member can be formed in a single step by the injection moulding of plastics material through a suitably shaped mould, or by casting a metal, e.g. Al, in a suitably shaped mould.

The completed frame can be arranged to have an attractive appearance by incorporating a series of curves or other ornamentation on the surface 34 of each frame member which makes up part of the front surface of the completed frame. On the other hand, the frame members can be moulded so as to include decorative effects along their length to give rise to a more fancy looking frame. Alternatively, decorative effects may be added to the frame members having a constant cross-section after their initial moulding or casting.

The frame illustrated in FIGS. 1–3 can be used as a free standing frame by resting it on a substantially horizontal surface. Alternatively, it may be suspended from a ceiling or on a wall by well known means, such as by fixing a length of chord, such as string, across its rear surface and suspending the frame by way of the chord on a nail or hook projecting from the ceiling or wall.

As another alternative, the frames of the invention can be provided with a rudder or strut type support attached to their rear surface, to enable them to stand on a substantially horizontal surface.

The frame members may form a frame other than a rectangular one depending upon the angle at which the ends of the frame members are mitred. Thus a hexagonal frame may be produced if six suitably mitred members are brought together.

Figure 4:
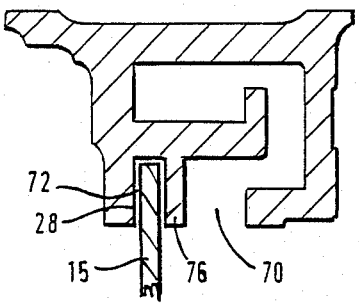
FIGS. 4, 5, 6, 7 and 8 are cross-sectional views of frame members according to five further embodiments of the present invention.

In the frame illustrated in FIG. 3, a difficulty arises when the number of articles to be framed e.g. a single photograph 15 is insufficient to fill the continuous groove of the frame compactly. This problem can be overcome by partitioning the sub-groove 22 of each of the frame members by a partitioning member 76 as illustrated in FIG. 4. Thus, the original sub-groove is divided into a wide sub-groove 70 and a narrow sub-groove 72 by a partitioning member 76. The partition may be in the form of a ridge formed integrally with the frame member. The whole construction of narrow and wide sub-grooves and a ridge may be produced in a continuous extrusion step if metal or plastics is used or by a continuous machining step from wood strip. Alternatively a single injection moulding step could be used.

The narrow sub-groove 72 may have a width of e.g. ⅛th inch (3.2 mm). The partition or ridge 76 may have a width of e.g. 1/16th inch (1.6 mm). It is preferred that the height of each ridge is the same as the height of the wall 28 of the sub-groove 22. In any case, the height of the ridge should be sufficient to allow for the secure mounting of the article to be framed. The wide sub-groove 70 may have a width of e.g. 1¼ inch (6.4 mm).

Such a frame may be used, for instance, for displaying photographs. Most camera films give rise to 12, 24 or 36 photographs. A frame made up of frame members according to FIG. 4, and designed to have a capacity for 36 or more photographs, may be used for holding the photographs of any one of these types of film. If only 12 photographs are to be framed, these may still be framed in this frame due to the provision of the partitioning member 76. Eleven of the photographs are placed in the wide sub-groove 70 which may also contain the negatives and the remaining photograph is placed on display in the narrow sub-groove 72.

FIGS. 5–8 illustrate four further preferred frame members by way of their cross-sectional appearance.

Figure 5:
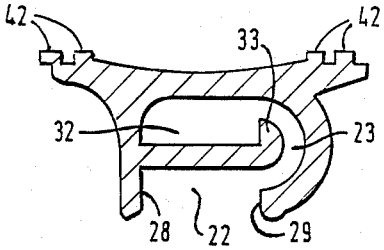

The frame member illustrated in FIG. 5 is similar to that illustrated in FIG. 3. However, the various surfaces of the frame member are formed to present a more curved and streamlined appearance, which some users may find more attractive than the design illustrated in FIG. 3. A frame made up of frame members according to FIG. 5 is best used as a free standing frame for use on a substantially horizontal surface. The frame rests on the small protruding legs 42 of the frame member which forms the base of the frame, which in turn depends upon the orientation of the frame.

Figure 6:
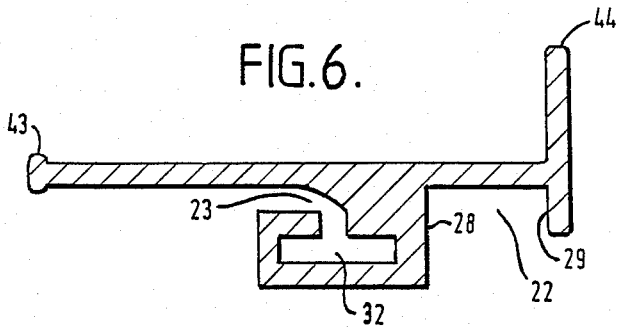

FIG. 6 illustrates a cross-sectional view through a frame member which when assembled into a frame produces a free-standing display frame which tilts the article on display to the vertical. As previously explained, the framed articles e.g. photographs are retained in a continuous grooves formed by the alignment of sub-grooves 22. The frame is placed on a substantially horizontal surface, any picture which it includes will be held at an angle to the vertical. This is because the frame member which forms the base of the frame rests on the surface only at points 43,44. In this embodiment, the entrance passage 23 leads from the rear of the frame to the sub-channel 32.

Figure 7:
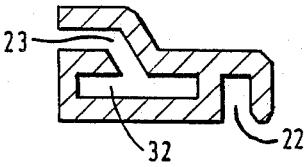
Figure 8:
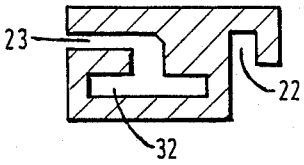

FIGS. 7 and 8 illustrate two further cross-sectional views through frame members in accordance with two further embodiments. In each of these, the entrance passage 23 leads from a surface of the frame member which forms part of the rear surface of the completed frame. The elastic band is threaded into sub-channel 32 by way of the entrance passage 23. The article to be framed is located within a groove formed around the forward internal perimeter of the frame by the alignment of sub-grooves 22.

Figure 9:
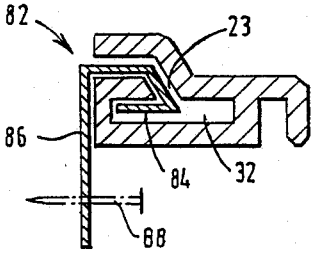
FIG. 9 is a cross-sectional view illustrating the use of a hook to suspend a frame made up of frame members as illustrated in FIG. 7.

Some of the frames of the present invention may be hung on walls by way of hooks. FIG. 9 illustrates a cross-sectional view of a frame member according to FIG. 7 including a hook 82 for hanging the frame. The hook comprises a portion 84 complimentary in shape to that of the entrance passage and part of the sub-channel of the frame member, and a projecting portion 86 through which a hole is provided for allowing the hook to hang from a nail 88 or the like. The hook 82 can slide along the entrance passage 23 and sub-channel 32 allowing the frame and picture to be balanced so that it hangs correctly. The hook can be moved between the frame members making up the frame by partially disassembling the frame and removing the hook from one frame member and replacing it in another. This allows the frame to be interchanged between portrait and landscape orientations.

The frame of the present invention has many uses, particularly in situations where it is desirable to interchange the article or articles which are being framed by others.

Thus, if the frame illustrated in FIG. 2 is used as a frame for photographs, the frame members 12 and 14 may be pulled in direction C, and flexed around joints 24 and 25 to allow the framed photograph to be removed from groove 22. If a plurality of photographs are housed within the frame, these may be reordered to move a different photograph to the front of the frame.

One particular application of the frame of the invention is in dispensing photographs produced from a roll of film or a disc. Thus all the photographs developed during the processing of a film might be returned to the photographer placed in the frame to give an inexpensive yet attractive "album".

When changing the picture on view, the frame can be simply rotated through 90° if necessary to follow a change in attitude e.g. from a portrait to a landscape.

Because of the simplicity of construction of the present frame, they may be easily constructed from kits. A suitable kit comprises two frame members of a given length and an elastic band. In the case where a rectangular article of known size is to be framed, the purchaser has only to buy two kits each comprising the two opposite sides of the frame and an elastic band, and assemble them.

The frame of the present invention is not restricted to framing picture type articles, but may also be used to frame or package video films, circuit boards, table-mats or X-ray plates.

Additionally, the shape of the frame members can be adapted to be complementary to the outline of the article for which it is intended. Thus, frame members can be readily constructed for framing an article having e.g. a triangular or hexagonal outline.

While generally more useful for framing planar articles, the present frame can be used for other purposes. For instance, it may be used as the framework for a toilet roll holder e.g. having an axle held between two opposite frame members. When the roll is finished, the frame can be pulled apart, the empty roll removed from the axle, a fresh roll slipped over the axle, and the frame reassembled.

We claim:

1. A frame for framing at least one article comprising a plurality of frame members arranged in end to end relationship to form the frame and means consisting solely of an elastic band, for maintaining said relationship, the elastic band being disposed in a continuous channel formed around the frame by the alignment of sub-channels located along the length of each of the frame members, each sub-channel having an entrance passage leading into it along the whole of its length arranged both to allow the elastic band to be threaded into the sub-channel and to prevent the elastic band from being visible after assembly of the frame.

2. A frame according to claim 1 wherein each frame member has two opposite ends and the sub-channel of each frame member is enclosed within the frame member except at its two ends, and except where the passage joins with the sub-channel.

3. A frame according to claim 1 having a front surface and a rear surface, and wherein the entrance passage extends between the sub-channel and the surface of each frame member which forms part of the rear surface of the frame.

4. A frame according to claim 3 further comprising a hook for hanging the frame which is complimentary in shape to at least part of the entrance passage and sub-channel of a frame member.

5. A frame according to claim 1 wherein the elastic band is of elongate cross-section and each sub-channel has an inwardly facing planar surface to support the elastic band.

6. A frame according to claim 1 wherein each frame member is straight and has both its ends mitred.

7. A frame according to claim 6 wherein each frame member is, except for its mitred ends, of identical cross-section.

8. A frame according to claim 1 wherein the surfaces of the frame members which constitute the internal perimeter of the frame include a sub-groove, the sub-grooves of each of the frame members being aligned on assembly of the frame to form a continuous groove around the internal perimeter of the frame for retaining the at least on article.

9. A frame according to claim 8 wherein the entrance passage of each frame member extends between its sub-groove and its sub-channel.

10. A frame according to claim 9 wherein the entrance passage extends through a side wall of the sub-groove.

11. A frame according to claim 10 wherein a tongue projects from the opposite side wall of the sub-groove, a first surface of the tongue forming the base of the sub-groove.

12. A frame according to claim 11 wherein the opposite face of the tongue forms the face of the sub-channel which supports the elastic band.

13. A frame according to claim 8 wherein the continuous groove is of sufficient width to frame a plurality of superimposed articles.

14. A frame according to claim 8 wherein each sub-groove is divided by at least one partitioning member into a wide sub-groove and a narrow sub-groove.

15. A frame according to claim 1 wherein the frame members are made from a material in the group consisting of extruded plastics, metal, and wood.

16. A frame according to claim 1 having four frame members adapted to frame at least one rectangular article.

17. A frame according to claim 16 comprising two members of a first length and two members of a second length.

18. A kit of parts for use in the assembly of a frame for framing at least one article comprising:

four separate frame members adapted to be arranged in end to end relationship to form the frame about at least one rectangular article, two of said members having a first length and the other two of said members having a second length; and means consisting solely of an elastic band for maintaining said relationship, the elastic band being disposed in a continuous channel formed around the frame by the alignment of sub-channels located along the length of each of the frame members, each sub-channel having an entrance passage leading into it along the whole of its length arranged both to allow the elastic band to be threaded into the sub-channel and to prevent the elastic band from being visible after assembly of the frame.

* * * * *